United States Patent [19]

Landa

[11] 4,302,093

[45] Nov. 24, 1981

[54] COMBINED TRANSFER AND REGISTRATION SYSTEM FOR ELECTROPHOTOGRAPHIC COPIER

[75] Inventor: Benzion Landa, Edmonton, Canada

[73] Assignee: Savin Corporation, Valhalla, N.Y.

[21] Appl. No.: 85,689

[22] Filed: Oct. 17, 1979

[51] Int. Cl.[3] ..... G03G 15/00

[52] U.S. Cl. ..... 355/3 TR; 29/132

[58] Field of Search ..... 355/3 TR, 3 TE, 3 R, 355/14 TR; 430/48, 126; 100/155 R, 176; 29/132

[56] References Cited

U.S. PATENT DOCUMENTS

| | | | |
|---|---|---|---|
| 3,751,156 | 8/1973 | Szostak et al. | 355/3 TR |
| 3,879,121 | 4/1975 | Simpson | 355/3 TR |
| 3,936,170 | 2/1976 | Shibano et al. | 355/3 TE |

FOREIGN PATENT DOCUMENTS

| | | | |
|---|---|---|---|
| 932788 | 8/1973 | Canada | 355/3 TR |

*Primary Examiner*—R. L. Moses
*Attorney, Agent, or Firm*—Shenier & O'Connor

[57] ABSTRACT

A combined image transfer and registration system for an electrophotographic copier in which a somewhat conductive transfer roller having a surface hardness which is approximately the same as that of the copy material is brought into spaced relationship with the photoconductor surface at a distance less than the thickness of the copy material. Prior to the arrival of the leading edge of the developed image adjacent to the transfer roller a length of copy material has been fed to the nip between a registration roller and the transfer roller to permit a registration signal to initiate rotation of the transfer roller through an overrunning clutch to move the copy material into the space between the image bearing surface and the transfer roller to clutch the transfer roller to the drum to cause the copy material to move synchronously with the image as the transfer takes place. A bias potential may be applied to the transfer roller to assist in effecting transfer.

37 Claims, 5 Drawing Figures

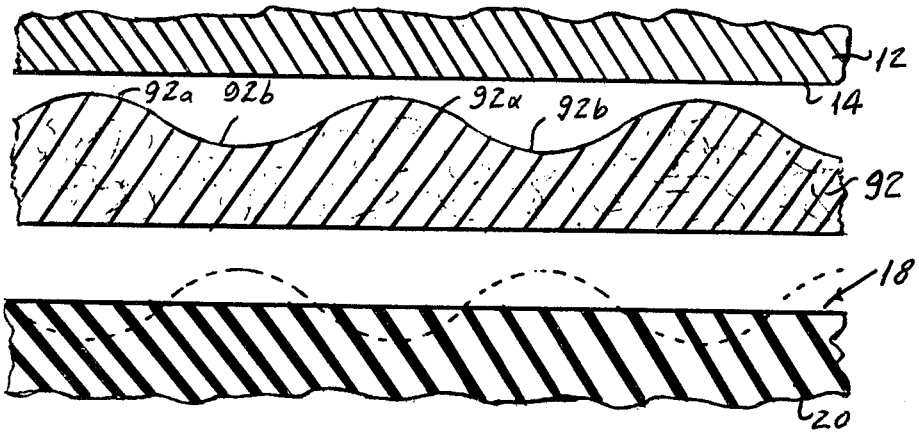
Fig 5
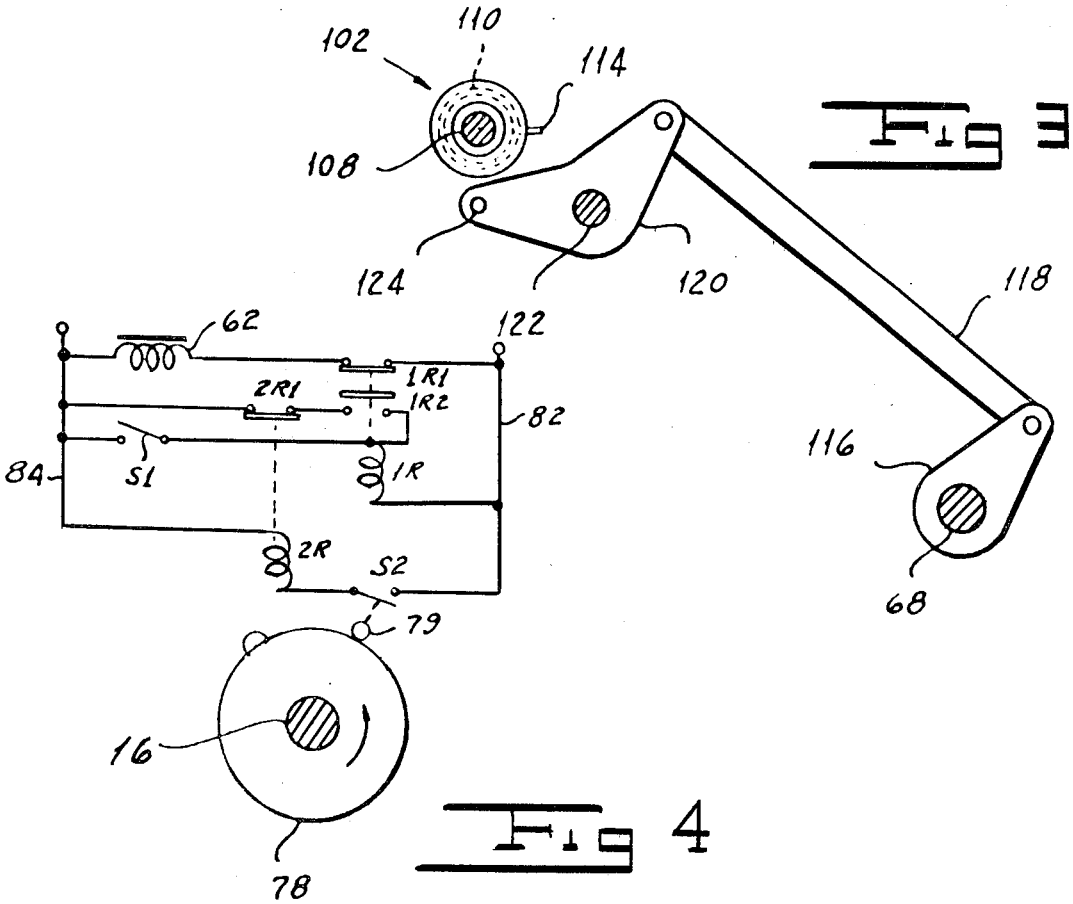
Fig 3
Fig 4

COMBINED TRANSFER AND REGISTRATION SYSTEM FOR ELECTROPHOTOGRAPHIC COPIER

BACKGROUND OF THE INVENTION

My invention relates to the field of electrophotographic copiers and, more particularly, to a system which combines the function of registration of the copy sheet with the image on the photoconductor and the function of transferring the developed image from the photoconductive surface to the copy paper.

Most electrophotographic copiers of the prior art include a drum carrying a coating of photoconductive material which is successively moved through a charging station at which a corona applies a uniform electrostatic charge to the surface, through an exposure station at which the surface is exposed to a light image of the original to result in an electrostatic latent image of the original and then through a developer station at which the latent image is subjected to the action of a developer including a carrier and particles of colored toner, which adhere to the surface over the charged areas thereof, thus to develop the image.

In at least one specific copying machine in the prior art, the sheet of paper to which the developed image is to be transferred is fed to the nip between a pair of registration rollers located adjacent to the surface of the member carrying the photoconductor prior to the arrival of the leading edge of the developed image at a location adjacent to the registration rollers. In timed sequence with the arrival of the leading edge of the developed image at a predetermined location, the registration rollers are driven to move the leading edge of the copy sheet into engagement with the drum surface in registration with the leading edge of the developed original. Next, the copy sheet and the developed image move together through a transfer station at which the developed image is transferred from the photoconductor surface to the surface of the copy sheet. Finally, the copy sheet is picked off the drum and delivered to the machine operator. Subsequently, the photoconductor surface may move through a cleaning station and, possibly, an exhaust exposure station.

Machines of the type described above incorporate a number of defects. The first of these is in the transfer operation, in the course of which the developed image is moved from the surface of the photoconductor to the surface of the copy sheet. The vast majority of electrostatic copying machines of the prior art employ a corona to effect transfer of the developed image from the surface of the photoconductor to the surface of the copy paper. This corona, which is located behind the copy sheet, is of such a polarity as to cause the toner particles making up the image to move from the surface of the photoconductor to the copy sheet. This system suffers from the defect that the contact between the surface of the paper and the surface of the photoconductor is not very good. Copy paper which is somewhat bowed or rough paper does not contact well enough to produce a good transfer and even smooth paper does not afford the uniform and complete contact which is necessary for optimum transfer of the image from the photoconductor surface to the paper. Evidence of this is the mottling which is present in solid black areas of the developed image.

As an alternative to the corona system described hereinabove, certain plain paper copiers have employed roller transfer devices in which a soft roller presses the copy paper against the surface of the photoconductor. This roller is made somewhat conductive and has a potential applied thereto which aids in transfer of the image. I have discovered that such relatively soft rollers do not provide the required pressure to deform the paper to afford as effective contact as is necessary, particularly where a relatively rough paper is being used. Not only does a system of this sort not provide contact which is as effective as is desirable but also, where a liquid developer is used the roller quickly becomes dirty as a result of contact with the photoconductive surface at the leading and trailing edges of the copy, and also beyond the edges of a relatively narrow sheet of copy paper where the machine is intended to accommodate different widths of copy paper. As the roller becomes dirty, it in turn dirties the back of the copies resulting in unsatisfactory copies.

In addition to the foregoing, as is known in the art, one of the most expensive components of most machines of the prior art is a drum which carries the photoconductive material. Space around the periphery of the drum is at a premium. That is to say, the number of elements which must be arranged around the periphery of the drum and the size of these elements in some degree dictate the diameter of the drum. Thus, if the number of elements which must be arranged around the surface of the drum can be reduced, the diameter of the drum and the resultant cost of the machine can be reduced.

SUMMARY OF THE INVENTION

One object of my invention is to provide a transfer system for an electrophotographic copier, which ensures a more effective transfer of the developed image from the surface of the photoconductor to the surface of the copy material.

Another object of my invention is to provide a combined transfer and registration system for an electrophotographic copier which effectively reduces the number of parts which must be located around the periphery of the drum carrying the photoconductive material.

Yet another object of my invention is to reduce the length of the copy path in an electrophotographic copier.

A still further object of my invention is to provide a system for an electrophotographic copier which combines the function of registering the leading edge of the copy sheet with the leading edge of the developed image on the photoconductor and the function of transferring the developed image from the photoconductor to the copy sheet.

A still further object of my invention is to provide a combined transfer and registration system for an electrophotographic copier which is simple for the result achieved thereby.

Other and further objects of my invention will appear from the following description.

In general my invention contemplates the provision of a combined transfer and registration system for an electrophotograhic copier in which a roller having a surface hardness which is approximately the same as that of the copy paper is brought into spaced relationship with the surface of the photoconductor at a distance which is less than the thickness of a sheet of paper at the transfer station during the transfer operation. This transfer roller, together with another roller in engagement therewith form a nip into which a copy sheet is fed and retained until the developed image arrives at a predetermined location around the axis of the drum at which time the second roller is driven, so that it together with the transfer roller act as registration rollers to introduce the leading edge of the copy sheet into the space between the transfer roller and the drum at the time the leading edge of the developed image enters the space between the transfer roller and the drum. When that occurs, the paper clutches the transfer roller to the drum, so that the transfer roller runs in synchronism with the drum and, possibly with the assistance of a bias potential applied to the transfer roller, the image is effectively transferred from the drum to the copy sheet. I provide my system with means for holding the transfer roller assembly away from the drum until the transfer operation is to take place.

BRIEF DESCRIPTION OF THE DRAWINGS

In the accompanying drawings, which form part of the instant specification and which are to be read in conjunction therewith and in which like reference characters indicate like parts in the various views:

FIG. 3 is a fragmentary sectional view illustrating a portion of the actuating mechanism of my system.

FIG. 4 is a schematic view of one form of electrical circuit which may be used to control the operation of my combined transfer and registration system for an electrophotographic copier.

FIG. 5 is a diagrammatic view illustrating the mode of operation of the transfer roller of my combined transfer and registration system for an electrophotographic copier.

DESCRIPTION OF THE PREFERRED EMBODIMENT

Figure 1:
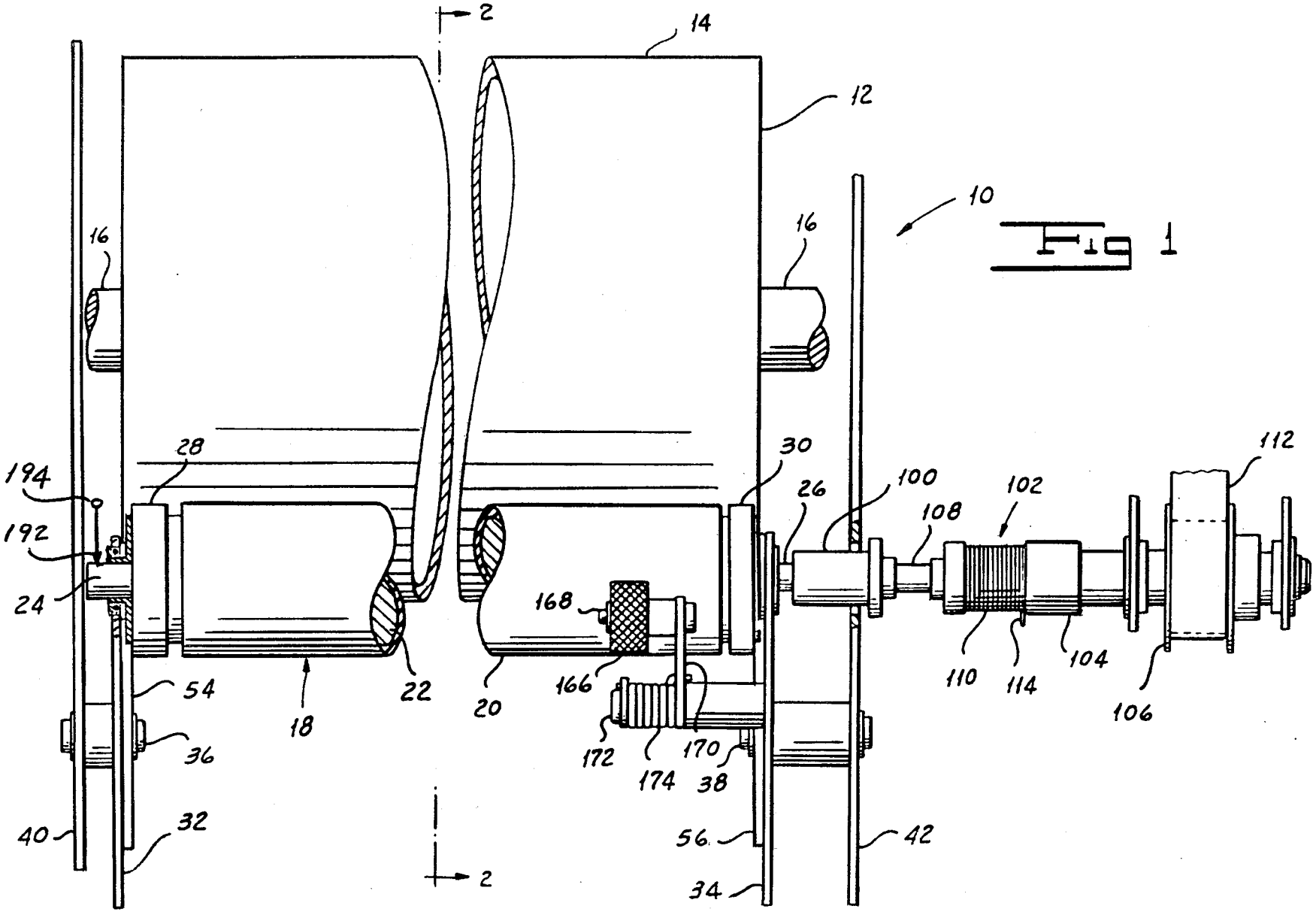
FIG. 1 is a top plan of a portion of an electrostatic copying machine incorporating my combined transfer and registration system with parts removed, with other parts broken away and certain parts shown in section.

Referring now to the drawings, an electrophotographic copier indicated generally by the reference character 10 incorporating my combied transfer and registration system includes a drum 12 having a surface 14 formed of a suitable photoconductive material such, for example, as selenium, or the like. A shaft 16 supports the drum 12 for rotary movement in the direction of the arrow indicated in FIG. 2.

My combined transfer and registration system includes a transfer roller indicated generally by the reference character 18 having a cover 20 carried by a core 22. As will be described more fully hereinbelow, the cover 20 is made from a material having a hardness which is approximately equal to the hardness of the copy paper and which is somewhat conductive. Core 22 may, for example, be metal. Respective stub shafts 24 and 26 carry spacer rollers 28 and 30, which are adapted to engage the surface 14. These rollers 28 and 30 may, for example, be the outer rings of ball bearings, so as to permit relative rotation between the roller 18 and the drum 12.

Figure 2:
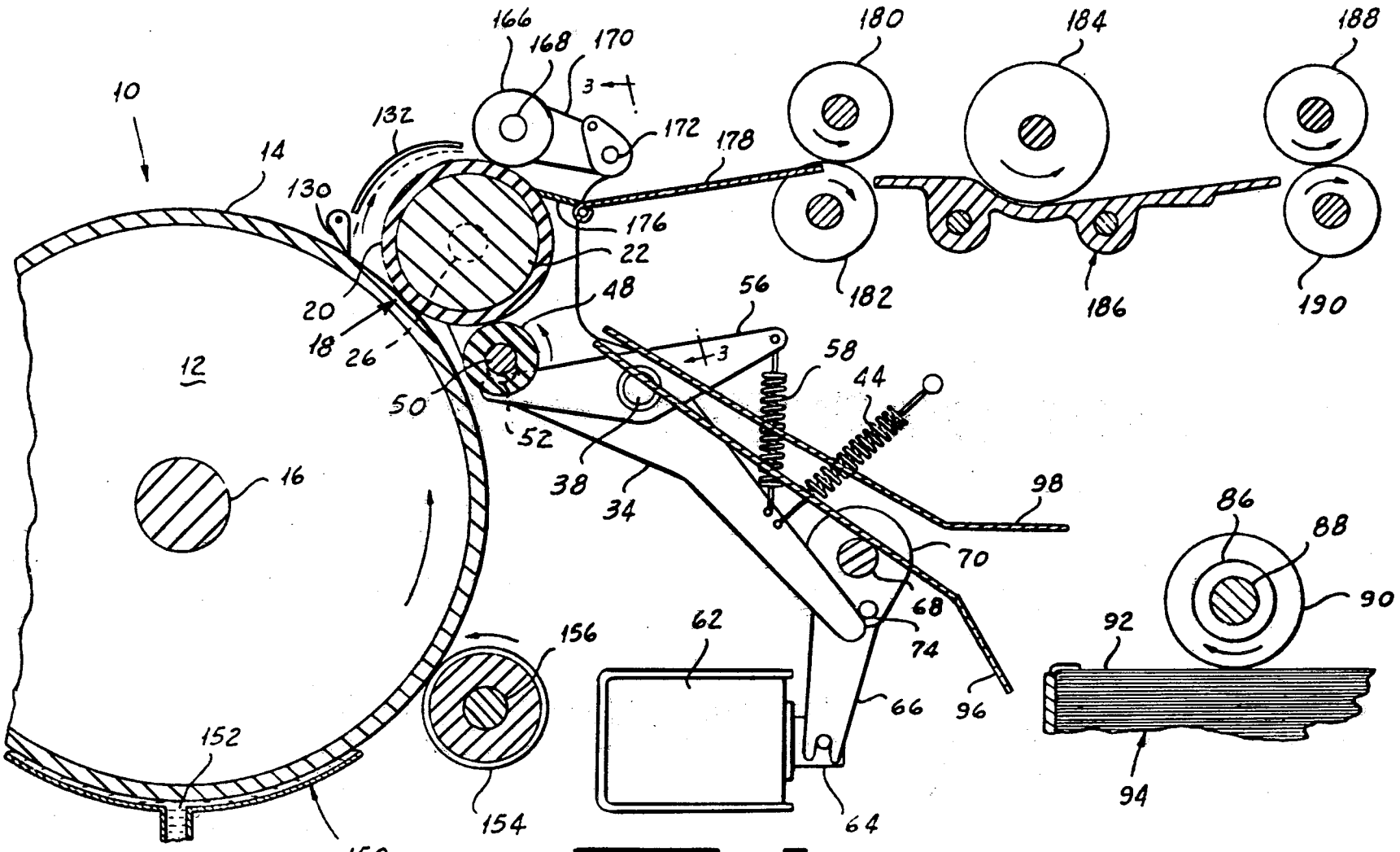
FIG. 2 is a sectional view of the machine shown in FIG. 1 and taken along the line 2-2 thereof.

I mount the shafts 24 and 26 in suitable bearings carried by a pair of arms 32 and 34 supported on pivot pins 36 and 38 carried by frame sides 40 and 42. Respective springs 44, one of which is shown in FIG. 2, urge the arms 32 and 34 in such a direction as to bring rollers 28 and 30 into engagement with the surface 14. As will more fully be explained hereinbelow, each of the rollers 28 and 30 has an outer diameter which is slightly greater than the outer diameter of the roller 18, so as to space the surface of the roller 18 from the surface 14 by a distance which is approximately half the thickness of a sheet of copy paper when the rollers 28 and 30 are in engagement with the surface 12 under the action of springs 44.

My system includes a registration roller 48 carried by a shaft 50, the ends of which are loosely supported in slots 52 in the arms 32 and 34. Respective arms 54 and 56 carried on the pivots 36 and 38 are urged by springs 58, one of which is shown in FIG. 2 to positions at which the ends of the levers 54 and 56 remote from the springs 58 engage the ends of shaft 50 to move the roller 48 into contact with the roller 18.

A solenoid 62 is adapted to be energized in a manner to be described to rotate a crank arm 66 carried by a shaft 68 in a clockwise direction as viewed in FIG. 2 to cause pins 74 on crank plates 72 carried by shaft 68 to engage the ends of arms 34 and 36 to rotate the arms in such a direction as to move the rollers 28 and 30 out of engagement with the surface 12.

A one-way clutch 86 is adapted to be actuated in any suitable manner known to the art to couple the feed roller 90 to a shaft 88 to cause the roller 90 to move the uppermost sheet 92 of a stack 94 of sheets upwardly through the space between a pair of sheet guides 96 and 98 and to the nip between rollers 48 and 18.

A universal coupling 100 connects the shaft 26 to a shaft 108 adapted to be driven from a pulley 106 through a spring clutch indicated generally by the reference character 102. A belt 112 drives pulley 106 to drive the input member 104 of clutch 102. The spring 110 of clutch 102 is connected at one end to shaft 108. This spring tends to wrap itself around the clutch member 104 in the direction of rotation of pulley 106 normally to cause the shaft 108 to be driven by the pulley 106. An offset 114 on spring 110 at the end remote from that connected to shaft 108 is adapted to be engaged in such a way as to prevent the spring from winding itself around member 104, thus to release the clutch. An arm 116 carried by shaft 68 is connected by a link 118 to a bell crank 120 carried by a shaft 122. Crank 120 carries a pin 124, which, upon energization of solenoid 62, is so positioned as to engage offset 114 to disengage the clutch 102.

From the structure thus far described, it will be apparent that, prior to the time at which a transfer operation is to take place, solenoid winding 62 is energized so as to hold the transfer mechanism away from the drum 12 and to disengage clutch 102. Before the time at which the transfer operation is to take place, the sheet 92 from the stack 94 is advanced to the nip between rollers 48 and 18. This operation may, for example, be performed in the manner shown in U.S. Pat. No. 4,009,957.

Referring now to FIG. 7, I connect winding 62 in series with a normally closed relay switch 1R1 between power lines 82 and 84. At some predetermined time in the course of operation of the machine, a synchronization signal is produced. This may, for example, be done in the manner described in the patent referred to hereinabove by the scanner of the machine, which closes a switch S1 connected in series with a relay winding 1R between conductors 82 and 84. When the winding 1R is thus energized, it opens switch 1R1 to deenergize solenoid 62. Concomitantly winding 1R closes switch 1R2 to complete its own holding circuit through a normally closed switch 2R1. This holding circuit is maintained for a period of time sufficient to ensure that the transfer operation is complete before the transfer mechanism is moved away from the surface 14. I may, for example, provide a cam 78 on shaft 16, which actuates a follower 79 to close a switch S2 at a time after the closure of switch S1 corresponding to the period of time required for the longest sheet to be used to pass through the transfer station. When S2 closes, it energizes winding 2R to open switch 2R1 to interrupt the holding circuit of winding 1R to permit solenoids 62 to be reenergized.

In addition to the structure described hereinabove, the machine 10 includes a developer applicator 150 adapted to apply liquid developer 152 to the latent image. After the image leaves applicator 150 it passes a "reverse roller" 154 carried by a shaft 156, which reverse roller removes excess developer material from the surface 14.

After leaving the transfer roller 18, the copy sheet 92 is picked off the surface of drum 12 by any suitable means. For example, a pivoted shoe 130 in engagement with the surface 14 lifts the sheet off the surface and directs it toward a guide 132. Guide 132 directs the leading edge of a sheet into the nip between a hold-down roller 166 and roller 18. Roller 166 is supported on a shaft 168 carried by an arm 170 pivotally supported on a shaft 172 on arm 34. A spring 174 on shaft 172 biases the roller 166 into engagement with the transfer roller 18.

After leaving the hold-down roller, the sheet is directed by guides 176 and 178 into the nip between a pair of rollers 180 and 182, which direct the sheet into the space between a hold-down roller 184 and a heater assembly 186 from which the sheet passes to rolls 188 and 190 which deliver the sheet to the user of the machine.

I have discovered that the hardness of the material of which the covering 20 is made is of paramount importance in effecting transfer of the developed image from the surface 14 to the surface of the sheet 92. Referring to FIG. 5, for purposes of discussion it is assumed that the surface of the sheet 92 facing the surface 14 is undulating in cross section having peaks **92*a* and 92*b* and that the opposite surface is flat. Assuming also for the purposes of the discussion that paper is substantially incompressible under the force exerted by springs 44, if a relatively soft material, such as has been used in the prior art, is employed to form the cover 20, and an attempt is made to transfer the image from the surface 14 to the surface of sheet 92 by pressing the sheet with the roller of relatively soft material, the valley areas 92*b* will not be moved into engagement with the surface 14. That is, over the region of contact the roller will not have the force distribution which would be necessary to deform the paper in such a way as to bring the valley areas into engagement with the surface 14. On the other hand, if a very hard roller such, for example, as a metal roller is used in an attempt to effect transfer by pressing the paper against the surface 14, but without sufficient force as to crush or compress the paper appreciably, again good transfer over the entire area will not be effected. This may be explained by the fact that the substantially incompressible paper material in the region of the peaks 92*a* act as pillars to support the roller, while the roller itself owing to its inherent high degree of hardness cannot assume such a configuration as would cause the valley areas to engage the surface 14**.

I have discovered that if the cover 20 is made of a material which has a hardness which is substantially the same as the hardness of the paper 92, valley areas **92*b* will be brought into engagement with the surface 14, so that good transfer is effected throughout the area of the copy. When such a material is employed, the surface thereof assumes a configuration which is the inverse of that illustrated for the surface of the paper adjacent to the surface 14. By way of example, I have illustrated such a configuration of the roller surface by the broken undulating line in FIG. 5. It is to be understood that the foregoing discussion in connection with the showing of FIG. 5** is by way of an attempt to illustrate the mode of operation of my transfer roller. In any event, I have discovered and have demonstrated that a roller having a hardness approximately equal to that of the copy material results in a transfer which is far superior to that obtainable by using a softer or a harder material. I measured the hardness of paper by taking a stack of paper and measuring the hardness with a Shore scleroscope.

More specifically, a material having a hardness which approaches the hardness of the paper would have a hardness of about 90 on the Shore A scale. In actual practice, materials having a Shore hardness of 80 on the Shore A scale do not provide the desired effective transfer. Neither do metal rollers. It is probable that materials within the range of durometer hardnesses of 85 and 95 on the Shore A scale would operate effectively in producing excellent transfer. In this connection, it is to be noted that while the paper is not compressible, it is deformable and what I have discovered is that the use of a material which has a hardness or flexural rigidity or compliance which is similar to that of the paper will result in a deformation of the paper and inverse deformation of the roller surface, which brings substantially all regions of the surface of the paper into engagement with the photoconductive surface.

In addition to the hardness set forth hereinabove the roller 18 made up of the core 22 and the cover 20 must possess a number of the qualities. It must be resistant to the action of the diluent used in the liquid developer in the machine. This diluent may, for example, be "Isopar" which is the trademark of the Standard Oil Company of New Jersey for an isomerized paraffinic hydrocarbon having a specific gravity of 0.75 at 60° F. The cover 20 should not swell or otherwise deform under the action of this liquid. The roller should be elastic so as not to acquire any permanent set under the action of the pressure applied to the paper. The resistivity of the material of cover 20 should be uniformly low of about $10^7$ ohm-cm. The uniformity of the resistivity is important. There should be no regions in which the resistivity is appreciably lower, such as would result in substantial short circuits or arcing when a potential is applied to the roller. The cover material should be dimensionally stable.

While the cover 20 of my roller 18 may be made of any suitable materials which will meet the qualifications set forth hereinabove, I have discovered that synthetic rubber incorporating a minor amount of carbon black particles in the required amount and dispersed throughout to give the necessary uniform resistivity is suitable. It will be recognized that manufacturers skilled in the art of making slightly conductive synthetic rubber rollers are well able to manufacture rollers meeting the requirements outlined above.

The importance of the spacing between the surface of roller 18 and that of drum 12 is to be emphasized. As is pointed out hereinabove, it is less than the thickness of a sheet of copy material and, preferably about half the thickness of an average copy sheet being used. It is to be noted, moreover, that the force with which springs 44 urge rollers 28 and 30 into engagement with the surface of drum 12 is sufficient to hold the rollers 28 and 30 in engagement with the drum as a sheet of copy material passes between roller 18 and drum 12.

In order to permit such bias as may be necessary or desirable to effect optimum transfer of the developed image from the surface 14 to the copy paper, I provide a brush 192 in engagement with shaft 124 to permit a biasing potential to be applied to the roller 18 from a terminal 194. It will readily be appreciated that where such a bias is provided roller 18 is insulated from the machine and from the rings 28 and 30.

In operation of an electrophotographic copying machine of the type incorporating the reverse roller 154 on start-up of the machine a thickness of developer liquid much greater than the thickness normally allowed is permitted to move upwardly with the surface 14 toward the roller 18. On start-up, the solenoid 62 is energized so as to hold the roller 18 away from the surface 14 for a distance of 1 or 2 millimeters to prevent the initial relatively thick layer of liquid developer from wetting the surface of the cover 20. After machine start-up and when a copy is to be made, the latent electrostatic image is developed upon the passage of the surface 14 by the developer applicator 150. As is pointed out more fully in U.S. Pat. No. 3,907,423, reverse roller 154 in the normal operation of the machine removes a substantial portion of the excess liquid from the surface before it moves into the transfer station. As the operation of making a copy is initiated, roll 90 is driven to move the uppermost sheet 92 to a position at which the leading edge is at the nip between roller 48 and roller 18. At a predetermined point in the operation of the machine, the scanning mechanism (not shown) or the like closes switch S1 to energize winding 1R. The time at which S1 closes corresponds to the time at which the leading edge of the developed image is moving to a position adjacent to the surface of roller 18. As winding 1R is energized it opens switch 1R1 to interrupt the circuit of solenoid 62. At the same time it completes its own holding circuit through switch 1R2 and a normally closed switch 2R1. Cam 78 driven by shaft 16 maintains the holding circuit complete for a sufficient period of time to permit the longest copy to be made.

When solenoid 62 is deenergized, springs 44 move rollers 28 and 30 into engagement with surface 14 to space the roller 18 by a spacing of approximately half the thickness of an ordinary copy sheet or about 0.05 mm from the surface 14. At the same time, clutch 102 engages so that roller 48 is driven at a speed which is somewhat less than the surface speed of drum 12. This action brings the leading edge of the copy sheet 92 into the space between roller 18 and surface 14 at the same time as the leading edge of the developed copy arrives at this location. As soon as the paper enters the space between roller 18 and surface 14, it clutches roller 18 to the surface 14 so that clutch 102 overruns and the copy sheet moves synchronously with the developed image through the transfer station. In the course of movement of the copy paper through the transfer station owing to the hardness of the surface of roller 18 relative to the hardness of the sheet 92, the valley areas **92*b* are brought into contact with or close proximity to the surface 14 and the surface of layer 20 assumes such a cross-sectional configuration as is necessary to bring about this result. In this manner excellent transfer of the developed image from the surface 14 to the copy sheet is achieved. Such biasing potential as may be necessary or desirable to enhance the transfer may be applied to the terminal 194. It will be appreciated that the bias is of a potential opposite in polarity to that of the toner particles. It may be sufficient to ground terminal 194**. Following transfer of the image to the copy sheet, the latter is picked off and delivered to the user of the machine.

It will be seen that I have accomplished the objects of my invention. I have provided a transfer arrangement for an electrophotographic copier which ensures a more effective transfer of the developed image from the surface of the photoconductor to the surface of the copy material than do transfer systems of the prior art. I have provided a combined transfer and registration system for an electrophotographic copier which effectively reduces the number of parts which must be disposed around the periphery of the drum carrying the photoconductive material. I have reduced the length of copy path in the electrostatic copier from the length of travel required in copiers of the prior art. I have provided a system which combines the function of registering a leading edge of the copy sheet with the leading edge of the developed image and the function of transferring the developed image from the photoconductor to the copy sheet in an electrophotographic copier. My combined transfer and registration system for an electrophotographic copier is simple in construction and operation for the results achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a copying machine having a surface adapted to receive a toned image which is moved past a transfer station at which said image is to be transferred to a length of copy material and having means for generating a synchronizing signal, apparatus including a transfer roller having a surface hardness approximately equal to the surface hardness of said copy material, said transfer roller being formed of a conductive material, means for applying a bias potential to said transfer roller, means mounting said transfer roller at said transfer station for movement from a first position relatively remote from said surface to a second position at which the surface of said roller is spaced from said surface by a distance which is approximately half the thickness of said copy material, a registration roller, said mounting means mounting said registration roller in cooperative relationship with said transfer roller to form a nip therewith, means for feeding a length of copy material to said nip, means including an overrunning clutch for driving one of said rollers to advance said length from said nip into the space between said surface and said transfer roller, entry of said length into said space clutching said transfer roller to said surface for movement therewith, means normally holding said transfer roller in said first position and holding said clutch disengaged and means responsive to said synchronizing signal for moving said transfer roller to said second position and for engaging said clutch.

2. In a copying machine having a surface adapted to receive a toned image which is moved past a transfer station at which said image is to be transferred to a length of copy material and having means for generating a synchronizing signal, apparatus including a transfer roller having a surface hardness approximately equal to the surface hardness of said copy material, means mounting said transfer roller at said transfer station for movement from a first position relatively remote from said surface to a second position at which the surface of said roller is spaced from said surface by a distance which is approximately half the thickness of said copy material, a registration roller, said mounting means mounting said registration roller in cooperative relationship with said transfer roller to form a nip therewith, means for feeding a length of copy material to said nip, means including an overrunning clutch for driving one of said rollers to advance said length from said nip into the space between said surface and said transfer roller, entry of said length into said space clutching said transfer roller to said surface for movement therewith, means normally holding said transfer roller in said first position and holding said clutch disengaged and means responsive to said synchronizing signal for moving said transfer roller to said second position and for engaging said clutch.

3. Apparatus as in claim 2 in which said transfer roller has a surface durometer hardness of between about 85 and about 95 to the Shore A scale.

4. Apparatus as in claim 2 in which the spacing between said surface and said transfer roller in its second position is approximately 0.05 mm.

5. In a copying machine having a surface adapted to receive a toned image which is moved past a transfer station at which said image is to be transferred to a length of copy material and having means for generating a synchronizing signal, apparatus including a transfer roller, means mounting said transfer roller at said transfer station for movement from a first position relatively remote from said surface to a second position at which the surface of said roller is spaced from said surface by a distance which is less than the thickness of said copy material, a registration roller, said mounting means mounting said registration roller in cooperative relationship with said transfer roller to form a nip therewith, means for feeding a length of copy material to said nip, means including an overrunning clutch for driving one of said rollers to advance said length from said nip into the space between said surface and said transfer roller, entry of said length into said space clutching said transfer roller to said surface for movement therewith, means normally holding said transfer roller in said first position and holding said clutch disengaged and means responsive to said synchronizing signal for moving said transfer roller to said second position and for engaging said clutch.

6. In a copying machine having a surface adapted to receive a toner image which is moved past a transfer station at which said image is to be transferred to a length of copy material and having means for generating a synchronizing signal, apparatus including a transfer roller, means mounting said transfer roller at said transfer station in a position at which the surface of said roller is spaced from said surface by a distance which is less than the thickness of said copy material, a registration roller, means mounting said registration roller in cooperative relationship with said transfer roller to form a nip therewith, means for feeding a length of copy material to said nip, means including an overrunning clutch for driving one of said rollers to advance said length from said nip into the space between said surface and said transfer roller, entry of said length into said space clutching said transfer roller to said surface for movement therewith, means normally holding said clutch disengaged and means responsive to said synchronizing signal for engaging said clutch.

7. In a copying machine having a surface adapted to receive a toner image and adapted to be moved past a transfer station at which said image is to be transferred to a length of copy material and having means for generating a synchronizing signal, apparatus including a transfer roller, means mounting said transfer roller at said transfer station for movement from a first position relatively remote from said surface to a second position at which the surface of said roller is spaced from said surface by a distance which is less than the thickness of said copy material, means normally holding said transfer roller in said first position and means responsive to said synchronizing signal for disabling said holding means.

8. In a copying machine in which a toned image is to be transferred from a surface carrying said image to a length of copy material, a transfer roller having a surface hardness approximately equal to the surface hardness of said copy material.

9. A transfer roller as in claim 8 in which said roller has a durometer hardness of between about 85 and about 95 on the Shore A scale.

10. A transfer roller as in claim 8 in which said roller is formed principally from a synthetic rubber.

11. A transfer roller as in claim 8 in which said roller is electrically conductive.

12. A transfer roller as in claim 8 formed with a major part of synthetic rubber and a minor part of conductive material.

13. A transfer roller as in claim 12 in which said conductive material is carbon black.

14. In a copying machine in which a developed image is to be transferred from the moving surface of a drum rotatable about an axis to the surface of a length of copy material, apparatus including a transfer roller, means mounting said transfer roller for rotary movement around an axis generally parallel to said drum axis, means for positioning the transfer roller adjacent to the drum with the roller surface spaced from the drum surface by a distance which is less than the thickness of a sheet of copy material, and means for introducing a sheet of copy material into the space between said roller and said drum.

15. Apparatus as in claim 14 in which the spacing between said roller and said drum is approximately half the thickness of said copy material.

16. Apparatus as in claim 14 in which the spacing between said roller and said drum is approximately 0.05 mm.

17. In a copying machine in which a developed image is to be transferred from the imaging area of the moving surface of a drum rotatable about an axis to the surface of a length of copy material, apparatus including a transfer roller, means mounting said transfer roller for rotary movement around an axis generally parallel to said drum axis, spacer roller means having an outer radius greater than the normal outer radius of said transfer roller, means mounting said spacer roller means for movement around said transfer roller axis and in engagement with said drum surface outside said imaging area to space said transfer roller surface from said drum surface, the difference between said transfer roller radius and said spacer roller means radius being less than the thickness of said copy material, and means for introducing a length of copy material into the space between said transfer roller and said drum.

18. In a copying machine in which a developed image is to be transferred from the imaging area of the moving surface of a drum rotatable about an axis to the surface of a length of copy material, apparatus including a transfer roller, means mounting said transfer roller for rotary movement around an axis generally parallel to said drum axis, spacer roller means having an outer radius greater than the normal outer radius of said transfer roller, means mounting said spacer roller means for rotary movement around said transfer roller axis relative to said transfer roller and in engagement with said drum surface outside said imaging area to space said transfer roller surface from said drum surface, the difference between said transfer roller radius and said spacer roller means radius being less than the thickness of said copy material, and means for introducing a length of copy material into the space between said transfer roller and said drum.

19. In a copying machine in which a developed image is to be transferred from the imaging area of the moving surface of a drum rotatable about an axis to the surface of a length of copy material, apparatus including a transfer roller, means mounting said transfer roller for rotary movement around an axis generally parallel to said drum axis, spacer roller means having an outer radius greater than the normal outer radius of said transfer roller, means for assembling said spacer roller means with said transfer roller means for rotary movement of said spacer roller means around said transfer roller axis, means mounting the assembly of said transfer roller means and said spacer roller means for movement between an inoperative position at which said roller means are out of engagement with said drum surface and an operative position at which said roller means engage said drum surface outside said imaging area, the difference between said transfer roller radius and said spacer roller means radius being less than the thickness of said copy material, and means for introducing a length of copy material into the space between said transfer roller and said drum with said assembly in its operative position.

20. In a copying machine in which a developed image is to be transferred from the imaging area of the moving surface of a drum rotatable about an axis to the surface of a length of copy material, apparatus including a transfer roller, means mounting said transfer roller for rotary movement around an axis generally parallel to said drum axis, spacer roller means having an outer radius greater than the normal outer radius of said transfer roller, means for assembling said spacer roller means with said transfer roller means for rotary movement of said spacer roller means around said transfer roller axis, means mounting the assembly of said transfer roller means and said spacer roller means for movement between an inoperative position at which said roller means are out of engagement with said drum surface and an operative position at which said roller means engage said drum surface outside said imaging area, the difference between said transfer roller radius and said spacer roller means radius being less than the thickness of said copy material, means for introducing a length of copy material into the space between said transfer roller and said drum with said assembly in its operative position, and means for urging said assembly to its operative position with a force sufficient to prevent said spacer roller means from moving away from said drum surface when a length of copy material is between said transfer roller and said drum.

21. In a copying machine in which a toner image is to be transferred from a moving surface carrying said image to a length of copy material, apparatus including a transfer roller having a surface hardness approximately equal to the hardness of said copy material, means for rotatably supporting said transfer roller adjacent to said surface with a spacing between said roller and said surface which is less than the thickness of said copy material, and means for introducing a length of said copy material into the space between said roller and said surface.

22. Apparatus as in claim 21 in which said roller has a surface durometer hardness between about 85 and about 95 on the Shore A scale.

23. In a copying machine in which a toner image is to be transferred from a moving surface carrying said image to a length of copy material, apparatus including a transfer roller having a surface durometer hardness between about 85 and about 95 on the Shore A scale, means for rotatably supporting said transfer roller adjacent to said surface with a spacing between said roller and said surface which is approximately half the thickness of said copy material, and means for introducing a length of said copy material into the space between said roller and said surface.

24. In a copying machine in which a toner image is to be transferred from a moving surface carrying said image to a length of copy material, apparatus including a transfer roller having a surface hardness approximately equal to the hardness of the copy material, means for rotatably supporting said transfer roller adjacent to said surface with a spacing between said roller and said surface which is less than the thickness of said copy material, said supporting means permitting relative movement between said transfer roller and said surface, and means for introducing a length of copy material into the space between said transfer roller and said surface to clutch said transfer roller to said surface.

25. In a copying machine in which a toned image is to be transferred from a moving surface carrying said image to a length of copy material, apparatus including a transfer roller, means for rotatably supporting said transfer roller adjacent to said surface with a spacing between said roller and said surface which is less than the thickness of said copy material, and means for introducing a length of said copy material into the space between said roller and said surface.

26. Apparatus as in claim 25 in which said supporting means spaces said transfer roller from said surface by a distance which is approximately half the thickness of said copy material.

27. Apparatus as in claim 25 in which said supporting means permits relative movement between said surface and said transfer roller.

28. Apparatus as in claim 25 in which said moving surface is driven, said supporting means being so constructed as to permit said length of copy material to clutch said roller to said surface as it is introduced into said space therebetween.

29. In a copying machine in which a toned image is to be transferred from a moving surface carrying said image to a length of copy material, apparatus including a transfer roller, means for rotatably supporting said transfer roller adjacent to said surface and for positively spacing said roller from said surface by a distance which is less than the thickness of said copy material, and means for introducing a length of said copy material into the space between said roller and said surface.

30. Apparatus as in claim 29 in which said supporting and spacing means has portions adapted to ride on said moving surface to space said transfer roller therefrom.

31. Apparatus as in claim 25 in which said supporting and spacing means has portions adapted to roll upon said moving surface to space said transfer roller therefrom.

32. In a copying machine in which a toned image is to be transferred from a surface carrying said image to a length of copy material, apparatus including a transfer roller having a surface hardness approximately equal to the surface hardness of said copy material, means for rotatably supporting said transfer roller adjacent to said surface to form a sheet-receiving nip, and means for introducing a length of said copy material into said nip.

33. Apparatus as in claim 32 in which said roller has a durometer hardness of between about 85 and about 95 on the Shore A scale.

34. Apparatus as in claim 32 in which said roller is formed principally from a synthetic rubber.

35. Apparatus as in claim 32 in which said roller is electrically conductive.

36. Apparatus as in claim 32 in which said transfer roller is formed with a major part of synthetic rubber and a minor part of conductive material.

37. Apparatus as in claim 36 in which said conductive material is carbon black.

* * * * *